US009370943B2

(12) United States Patent
Hobo et al.

(10) Patent No.: US 9,370,943 B2
(45) Date of Patent: Jun. 21, 2016

(54) CONVEYOR DEVICE AND INKJET RECORDING APPARATUS

(71) Applicant: KYOCERA Document Solutions Inc., Osaka (JP)

(72) Inventors: Jumpei Hobo, Osaka (JP); Takeshi Watanabe, Osaka (JP); Hidenori Takenaka, Osaka (JP); Tomohisa Soda, Osaka (JP); Masami Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/679,478

(22) Filed: Apr. 6, 2015

(65) Prior Publication Data

US 2015/0290953 A1 Oct. 15, 2015

(30) Foreign Application Priority Data

Apr. 10, 2014 (JP) ..... 2014-081063

(51) Int. Cl.

| | |
|---|---|
| ***B41J 2/01*** | (2006.01) |
| ***B41J 29/38*** | (2006.01) |
| ***B41J 11/00*** | (2006.01) |
| ***B65H 5/22*** | (2006.01) |

(52) U.S. Cl.

CPC ..... *B41J 11/007* (2013.01); *B41J 11/0085* (2013.01); *B65H 5/224* (2013.01); *B65H 2406/31* (2013.01); *B65H 2406/322* (2013.01)

(58) Field of Classification Search

CPC ..... B41J 11/0085; B41J 11/06; B41J 11/007; B41J 2/175

USPC ..... 347/85, 104, 16

See application file for complete search history.

(56) References Cited

U.S. PATENT DOCUMENTS

| | | | | |
|---|---|---|---|---|
| 2010/0117293 | A1 | 5/2010 | Shinohara | |
| 2011/0057380 | A1* | 3/2011 | Maeyama | B41J 11/0085 271/226 |
| 2013/0162742 | A1* | 6/2013 | Inoue et al. | 347/104 |

FOREIGN PATENT DOCUMENTS

| | | | |
|---|---|---|---|
| JP | 2010-111507 | A | 5/2010 |
| JP | 2011230463 | A * | 11/2011 |
| JP | 2012051330 | A * | 3/2012 |

* cited by examiner

*Primary Examiner* — Jannelle M Lebron

(74) *Attorney, Agent, or Firm* — Studebaker & Brackett PC

(57) ABSTRACT

A conveyor device includes a conveyor belt and a suction section. The conveyor belt conveys a recording medium. The suction section sucks on the recording medium through the conveyor belt. The suction section has a plurality of through holes. The suction section includes an air flow chamber. The air flow chamber has an air outlet in a bottom thereof. The bottom has first regions and a second region. The first regions are each located at a position opposite to a corresponding one of the through holes. The first regions are each located adjacent to the second region. The air outlet is located within the second region.

7 Claims, 8 Drawing Sheets

CONVEYOR DEVICE AND INKJET RECORDING APPARATUS

INCORPORATION BY REFERENCE

The present application claims priority under 35 U.S.C. §119 to Japanese Patent Application No. 2014-81063, filed Apr. 10, 2014. The contents of this application are incorporated herein by reference in their entirety.

BACKGROUND

The present disclosure relates to a conveyor device and an inkjet recording apparatus.

A conveyor device that conveys a recording medium using a conveyor belt has been offered as a conveyor device to be mounted in an inkjet recording apparatus. A recording head ejects ink onto a recording medium, and thus an image is formed. The conveyor device uses negative pressure created by a fan in order to convey the recording medium on the conveyor belt in a stable manner.

Some conveyor mechanisms (conveyor devices) include a platen belt (conveyor belt) and a platen plate (guide member) that supports the conveyor belt. Negative pressure is created and applied to a recording medium through conveyor belt holes (suction holes) and guide member suction holes (through holes) to suck the recording medium onto the conveyor belt. Thus, the recording medium is prevented from coming off the conveyor belt and being deformed to have a wrinkle or a wave in a surface thereof during conveyance. As a result, the conveyor devices can ensure that the recording medium is flat right under a recording head.

SUMMARY

According to a first aspect of the present disclosure, a conveyor device includes a conveyor belt and a suction section. The conveyor belt conveys a recording medium. The suction section sucks on the recording medium through the conveyor belt. The suction section has a plurality of through holes. The suction section includes an air flow chamber. The air flow chamber has an air outlet in a bottom thereof. The bottom has a plurality of first regions and a second region. The first regions are each located at a position opposite to a corresponding one of the through holes. The first regions are each located adjacent to the second region. The air outlet is located within the second region.

An inkjet recording apparatus according to a second aspect of the present disclosure includes the conveyor device according to the first aspect of the present disclosure and the recording head. The recording head is disposed opposite to the conveyor device.

DETAILED DESCRIPTION

Figure 1:
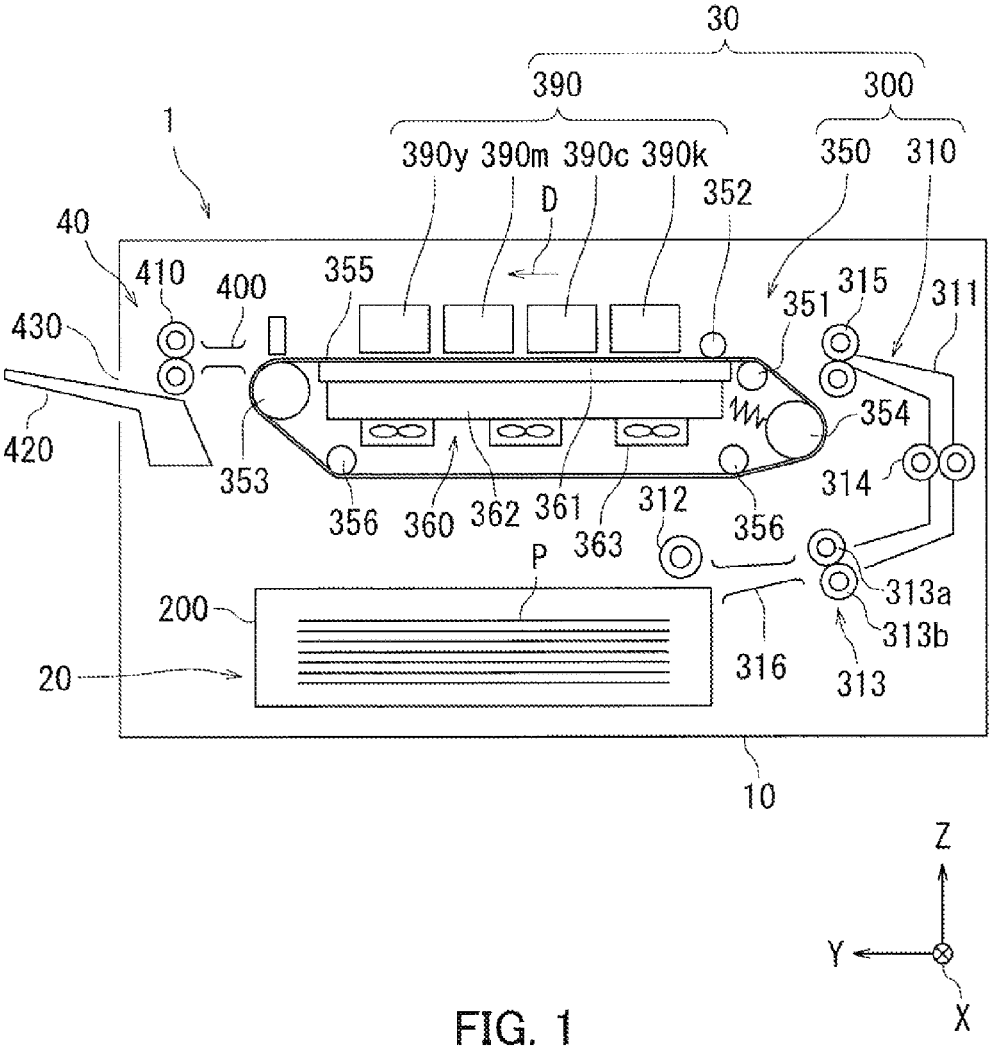
FIG. 1 is a schematic illustration of configuration of an inkjet recording apparatus including a conveyor device according to an embodiment of the present disclosure.

Hereinafter, embodiments of the present disclosure will be described with reference to the accompanying drawings. In the figures of the accompanying drawings, the like reference numerals refer to similar elements, and explanation thereof is not repeated.

(Configuration of Inkjet Recording Apparatus 1)

The inkjet recording apparatus 1 will be described with reference to FIG. 1. FIG. 1 is a schematic illustration of configuration of the inkjet recording apparatus 1 including a conveyor device 300 according to an embodiment of the present disclosure. The inkjet recording apparatus 1 includes a housing 10, a paper feed section 20 disposed in a lower location in the housing 10, an ink-jet image forming section 30, and a paper ejecting section 40.

The paper feed section 20 includes a paper feed cassette 200. The paper feed cassette 200 is detachably mounted in the housing 10. A plurality of sheets of recording medium P are stacked and loaded in the paper feed cassette 200. The recording medium P is paper such as plain paper, recycled paper, thin paper, or thick paper, for example.

The image forming section 30 includes the conveyor device 300 and a recording head 390. The conveyor device 300 includes a first paper conveyance section 310 and a second paper conveyance section 350 disposed opposite to the recording head 390. The second paper conveyance section 350 is located between the first paper conveyance section 310 and the paper ejecting section 40. The image forming section 30 may include a drier (not shown). The drier dries ink droplets ejected onto the recording medium P.

The first paper conveyance section 310 has a substantially C-shaped paper conveyance path 311. The first paper conveyance section 310 includes a paper feed roller 312 disposed above one end of the paper feed cassette 200, a pair of first conveyance rollers 313 disposed at an inlet of the paper conveyance path 311, a pair of second conveyance rollers 314 disposed at a midway portion of the paper conveyance path 311, a pair of registration rollers 315 disposed at an outlet of the paper conveyance path 311, and guide plates 316.

An X axis in FIG. 1 is parallel to a direction perpendicular to a conveyance direction D of the recording medium P. A Y axis is parallel to the conveyance direction D of the recording medium P on a guide member 361. A Z axis is parallel to a direction perpendicular to the guide member 361. In the embodiment, the Z axis is a vertical direction. The X axis, the Y axis, and the Z axis are perpendicular to one another.

The guide plates 316 are disposed between the paper feed roller 312 and the pair of first conveyance rollers 313. The paper feed roller 312 takes out the recording medium P in the paper feed cassette 200 sheet by sheet. The guide plates 316 guide the recording medium P taken out by the paper feed roller 312 to the pair of first conveyance rollers 313.

The pair of first conveyance rollers 313 catches and conveys the recording medium P guided thereto by the guide plates 316 toward the paper conveyance path 311. Specifically, the pair of first conveyance rollers 313 includes a feed roller 313*a* and a retard roller 313*b*. The feed roller 313*a* and the retard roller 313*b* are opposed to each other and pressed against each other. The feed roller 313*a* rotates to convey the recording medium Pin the conveyance direction D. The retard roller 313*b* is driven by the feed roller 313*a* to rotate when receiving one sheet of recording medium P. Upon receiving a plurality of sheets of recording medium P at the same time, on the other hand, the retard roller 313*b* stops or rotates in a direction opposite to a direction for conveying the recording medium P to separate a sheet(s) of recording medium P from a sheet of recording medium P in contact with the feed roller 313*a*. As a result, one sheet of recording medium P is fed by the feed roller 313*a*.

The pair of second conveyance rollers 314 catches and conveys the recording medium P conveyed thereto by the pair of first conveyance rollers 313 toward the pair of registration rollers 315. The pair of registration rollers 315 performs skew correction on the recording medium P that has arrived and stopped at the pair of registration rollers 315. The pair of registration rollers 315 temporarily holds the recording medium P to synchronize the conveyance of the paper P and printing, and then conveys the recording medium P to the second paper conveyance section 350 in a timed relationship with the printing.

The second paper conveyance section 350 includes a speed sensing roller 351, a placing roller 352, a drive roller 353, a tension roller 354, a pair of guide rollers 356, an endless conveyor belt 355, and a suction section 360. The conveyor belt 355 is wound around the speed sensing roller 351, the drive roller 353, the tension roller 354, and the pair of guide rollers 356 in a tensioned manner. The conveyor belt 355 has a conveyance surface on which the recording medium P is placed and a conveyance back surface opposite to the conveyance surface. Rotation axes of the rollers such as the drive roller 353 are parallel to the X axis. The conveyor belt 355 has a plurality of suction holes (not shown). Each of the suction holes penetrates the conveyor belt 355 from the conveyance surface through to the conveyance back surface.

The speed sensing roller 351 is located upstream of the guide member 361 in terms of the conveyance direction D of the recording medium P. The speed sensing roller 351 includes a pulse plate (not shown). The speed sensing roller 351 rotates in contact with the conveyor belt 355. The rotational speed of the conveyor belt 355 is sensed by measuring the rotational speed of the pulse plate rotating integrally with the speed sensing roller 351. The speed sensing roller 351 restricts influence of meandering correction on the conveyor belt 355 under the recording head 390.

The placing roller 352 is located at an upstream end of the guide member 361 in terms of the conveyance direction D with the conveyor belt 355 therebetween. The placing roller 352 conveys the recording medium P in the conveyance direction D while pressing the recording medium P against the conveyor belt 355 and the guide member 361. The placing roller 352 reduces curl of the recording medium P so that the suction section 360 can suck on the recording medium P entirely and uniformly. As a result, the contact between the recording medium P and the conveyor belt 355 is made closer.

It is preferable that the moment of inertia of the placing roller 352 is low and the placing roller 352 is light in order to reduce impact vibrations on the placing roller 352 when the recording medium P comes under the placing roller 352. For example, the placing roller 352 is formed from an aluminum hollow pipe or a hollow pipe including a plurality of ribs. Where the surface of the placing roller 352 is formed from aluminum, the surface is preferably subjected to alumite treatment in order to reduce abrasion of the surface of the placing roller 352. The alumite treatment herein refers to a treatment involving electrochemically anodizing the aluminum surface in an acid treatment bath through electrolysis and thereby forming an aluminum oxide coating. The alumite treatment imparts electrical insulation to the placing roller 352. However, the surface of the placing roller 352 does not need to be subjected to the alumite treatment where the placing roller 352 needs to be electrically conductive.

The speed of conveyance of the recording medium P by the pair of registration rollers 315 may be different from the speed of conveyance of the recording medium P by the conveyor belt 355. The conveyance speed difference can be overcome by applying pressing force from the placing roller 352 to the recording medium P on the conveyor belt 355 and thus causing flexing of the recording medium P between the pair of registration rollers 315 and the placing roller 352.

The drive roller 353 is disposed in a spaced relationship to the speed sensing roller 351 in terms of the conveyance direction D of the recording medium P. The speed sensing roller 351 and the drive roller 353 maintain the conveyor belt 355 flat on the guide member 361. The drive roller 353 is in close contact with the conveyor belt 355 because of frictional force. In a configuration in which the conveyor belt 355 is made from a resin such as polyimide (PI), polyamide-imide (PAI), polyvinylidene fluoride (PVDF), or polycarbonate (PC), for example, it is preferable to wind a rubbery material such as ethylene propylene diene monomer (EPDM) rubber, polyurethane resin, or nitrile rubber (NBR) around the surface of the drive roller 353. In a configuration in which the image forming section 30 forms an image on the recording medium P using an aqueous ink, in particular, it is preferable to wind ethylene propylene diene monomer (EPDM) rubber around the drive roller 353 in order to prevent swelling of the rubbery material around the drive roller 353.

In a configuration in which the conveyor belt 355 includes a rubbery material such as ethylene propylene diene monomer (EPDM) rubber, the surface of the drive roller 353 may be made from a metal. In a configuration in which the surface of the drive roller 353 is made from aluminum, the surface of the drive roller 353 is preferably subjected to alumite treatment in order to reduce abrasion of the surface of the drive roller 353. The alumite treatment imparts electrical insulation to the drive roller 353. However, the surface of the drive roller 353 is not subjected to the alumite treatment where the drive roller 353 needs to be electrically conductive. In a configuration in which the drive roller 353 is in electrical communication with the conveyor belt 355, reduction in the accuracy of ink landing is restricted by electrically grounding the conveyor belt 355. In this case, the rubbery material included in the conveyor belt 355 is given electrical conductivity.

The drive roller 353 is driven by a motor (not shown) to rotate and cause the conveyor belt 355 to rotate counterclockwise. If the speed of the conveyor belt 355 is non-constant, non-constant speed correction control is exercised on the conveyor belt 355. The non-constant speed correction control is exercised to correct the non-constant rotation speed of the conveyor belt 355 so that the rotation speed of the conveyor belt 355 is constant. It is preferable that the moment of inertia of the drive roller 353 is low and the drive roller 353 is light for the non-constant speed correction control. For example, the drive roller 353 is made from an aluminum hollow pipe or a hollow pipe including a plurality of ribs. In the absence of the non-constant speed correction control, on the other hand, it is preferable that the drive roller 353 is heavy in order to stabilize the rotation of the drive roller 353 by the flywheel effect due to the inertia of the drive roller 353. In this case, the drive roller 353 is made from a solid metal.

The tension roller 354 is disposed at a section of the conveyor belt 355 that is located upstream of the guide member 361. The tension roller 354 tensions the conveyor belt 355 in order to prevent flexing of the conveyor belt 355. Shifting one end of the tension roller 354 enables automatic correction of meandering of the conveyor belt 355.

The conveyor belt 355 conveys the recording medium P sucked on the conveyor belt 355. The conveyor belt 355 is preferably made from polyamide-imide (PAI) or polyimide (PI), for example. Such materials prevent the conveyor belt 355 from having uneven thickness.

The pair of guide rollers 356 is disposed under the suction section 360. The pair of guide rollers 356 is fixed, maintaining a space defined by the internal peripheral surface (conveyance back surface) of the conveyor belt 355. Of the pair of guide rollers 356, a guide roller 356 that is closer to the drive roller 353 maintains the degree to which the conveyor belt 355 is wound around the drive roller 353. Of the pair of guide rollers 356, the other guide roller 356 that is closer to the tension roller 354 maintains the degree to which the conveyor belt 355 is wound around the tension roller 354 for stable correction of meandering of the conveyor belt 355.

The suction section 360 is disposed at the conveyance back surface of the conveyor belt 355 and opposite to the recording head 390 with the conveyor belt 355 therebetween. The suction section 360 includes a guide member 361, an air flow chamber 362, and one or more sucking devices 363.

The air flow chamber 362 has a hollow box-like shape opened at the top. That is, an opening is formed in the top of the air flow chamber 362. The guide member 361 covers (blocks) the top opening of the air flow chamber 362. The guide member 361 supports the recording medium P via the conveyor belt 355.

The sucking device 363 is disposed in communication with the air flow chamber 362 and draws air in the air flow chamber 362 to create negative pressure in the air flow chamber 362. As a result, the recording medium P is sucked toward the top of the air flow chamber 362 through the conveyor belt 355 and the guide member 361. It should be noted here that negative pressure refers to pressure lower than reference pressure. The reference pressure referred to in the present specification is atmospheric pressure. Negative pressure "$P_N$" is an absolute value of ($P_A$−$P_R$), wherein "$P_A$" represents the absolute pressure and "$P_R$" represents the reference pressure ($P_N$=|$P_A$−$P_R$|). The absolute pressure is pressure based on the absolute vacuum of 0. The air flow chamber 362 functions as a decompression chamber.

The recording head 390 includes one or more inkjet heads 390*k*, one or more inkjet heads 390*c*, one or more inkjet heads 390*m*, and one or more inkjet heads 390*y*. Each of the inkjet heads 390*k*, 390*c*, 390*m*, and 390*y* ejects ink.

The paper ejecting section 40 includes a conveyance guide 400, a pair of ejection rollers 410, and an exit tray 420. The conveyance guide 400 is located downstream of the second paper conveyance section 350 in terms of the conveyance direction D of the recording medium P. The exit tray 420 is fixed to the housing 10 and projected outward from an exit port 430 formed in the housing 10.

The conveyance guide 400 guides the recording medium P being conveyed from the conveyor belt 355 to the pair of ejection rollers 410. The recording medium P that has passed through the conveyance guide 400 is conveyed by the pair of ejection rollers 410 to the exit port 430 and ejected onto the exit tray 420 through the exit port 430.

First Embodiment

Basic Configuration

Figure 2:
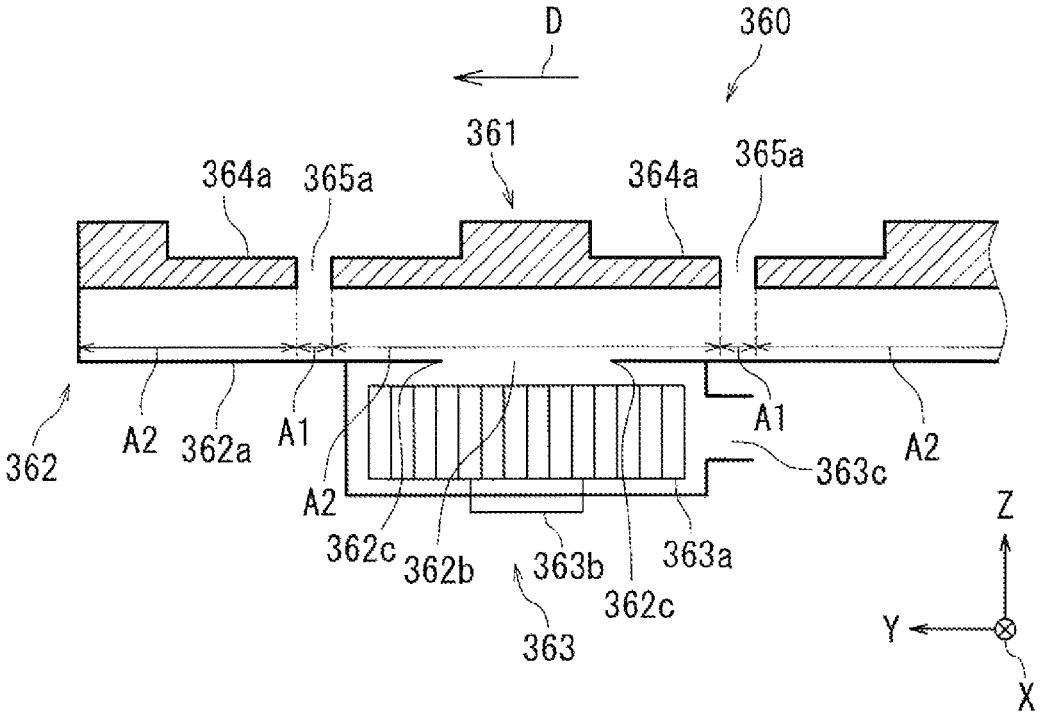
FIG. 2 is a side view illustrating a suction section of the conveyor device according to the first embodiment of the present disclosure.
Figure 3:
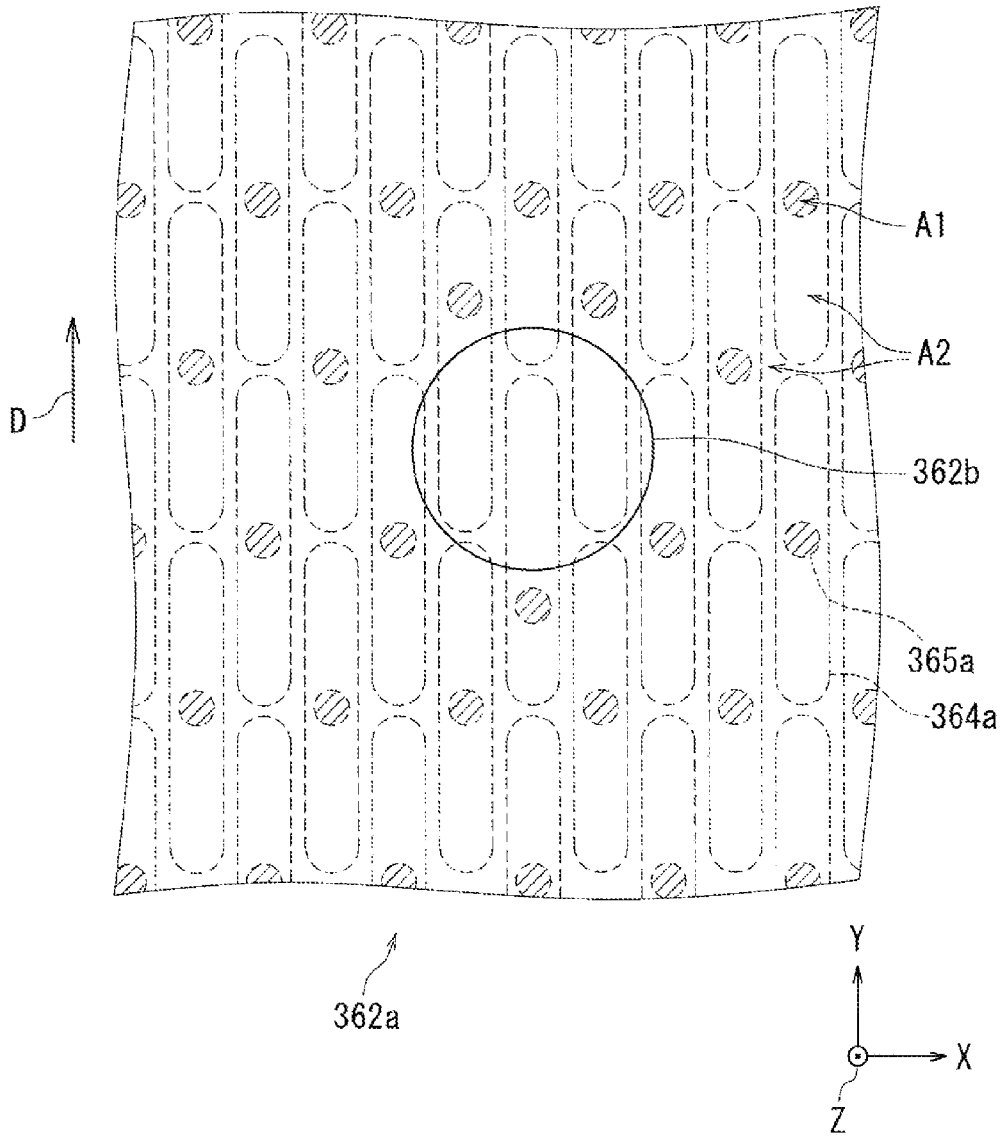
FIG. 3 is a plan view illustrating a bottom of an air flow chamber of the conveyor device according to the first embodiment of the present disclosure.

The basic configuration of the conveyor device 300 according to a first embodiment of the present disclosure will be described with reference to FIGS. 1-3. FIG. 2 is a side view illustrating the suction section 360. FIG. 3 is a plan view illustrating a bottom 362*a* of the air flow chamber 362.

The suction section 360 sucks on the recording medium P through the conveyor belt 355. A plurality of grooves 364*a* are formed in the guide member 361 in the suction section 360. Each of the grooves 364*a* has an oval shape and extends along the conveyance direction D of the recording medium P. Each of the grooves 364*a* has a length along the conveyance direction D of 54 mm. Each of the grooves 364*a* has a length along a direction perpendicular to the conveyance direction D of 6 mm. The grooves 364*a* are in a staggered arrangement along the conveyance direction D and the direction perpendicular to the conveyance direction D. Each of the grooves 364*a* has a through hole 365*a*. Each of the through holes 365*a* has a diameter of 6 mm. Each of the through holes 365*a* is located at one end, at the other end, or in the center of the corresponding groove 364*a*. For example, the through holes 365*a* are in a staggered arrangement along the direction perpendicular to the conveyance direction D.

The bottom 362*a* of the air flow chamber 362 has an air outlet 362*b*. The air outlet 362*b* has a diameter of 50 mm. The sucking device 363 is in communication with the air flow chamber 362 via the air outlet 362*b*. The bottom 362*a* has first regions A1 and a second region A2. The first regions A1 overlap with the respective through holes 365*a*. The first regions A1 are each located adjacent to the second region A2. The air outlet 362*b* is formed in the second region A2.

Upon actuation of the sucking device 363 with the recording medium P on the conveyance surface of the conveyor belt 355, negative pressure is created in the air flow chamber 362. The sucking device 363 includes a fan 363*a*, a fan shaft 363*b*, and a fan air outlet 363*c*. The negative pressure acts on the recording medium P through the air outlet 362*b*, the through holes 365*a*, the grooves 364*a*, and the suction holes of the conveyor belt 355. Air is drawn by the sucking device 363 and discharged to the outside of the suction section 360 through the fan air outlet 363*c*. The conveyor belt 355 conveys the recording medium P in the conveyance direction D as it rotates. The conveyor belt 355 has a thickness of 100 μm. Each of the suction holes of the conveyor belt 355 has a diameter of 2 mm.

FIG. 3 shows the positional relationship between the through holes 365*a*, the first regions A1, the second region A2, and the air outlet 362*b*. In order to clearly show the positional relationship between the through holes 365*a*, the first regions A1, the second region A2, and the air outlet 362*b*, the fan 363*a* and the fan shaft 363*b* are not shown in FIG. 3. The air outlet 362*b* is located in the second region A2 adjacent to the first regions A1. Accordingly, the through holes 365*a* do not overlap with the air outlet 362*b* in a plan view. That is, the air outlet 362*b* is not located right under the through holes 365*a*.

Since the air outlet 362*b* is formed in the second region A2 in the conveyor device 300 as described with reference to FIGS. 1-3, the air outlet 362*b* does not overlap with the through holes 365*a*. This configuration prevents ink that has been abnormally ejected by the recording head 390 and that has flowed into the air flow chamber 362 through the through holes 365*a* from flowing directly into the air outlet 362*b*. Thus, contamination of the fan 363*a* by the ink is reduced. As a result, the suction force of the sucking device 363 can be maintained stable for a long period of time.

The positions of the through holes 365*a* formed in the respective grooves 364*a* may be changed according to the position of the air outlet 362*b* and the shape of a peripheral edge 362*c* of the air outlet 362*b*. Thus, it is possible to reduce contamination of the fan 363*a* without changing the positions of the sucking device 363 and the air outlet 362*b*.

[Variation of Air Outlet 362*b*]

Figure 4:
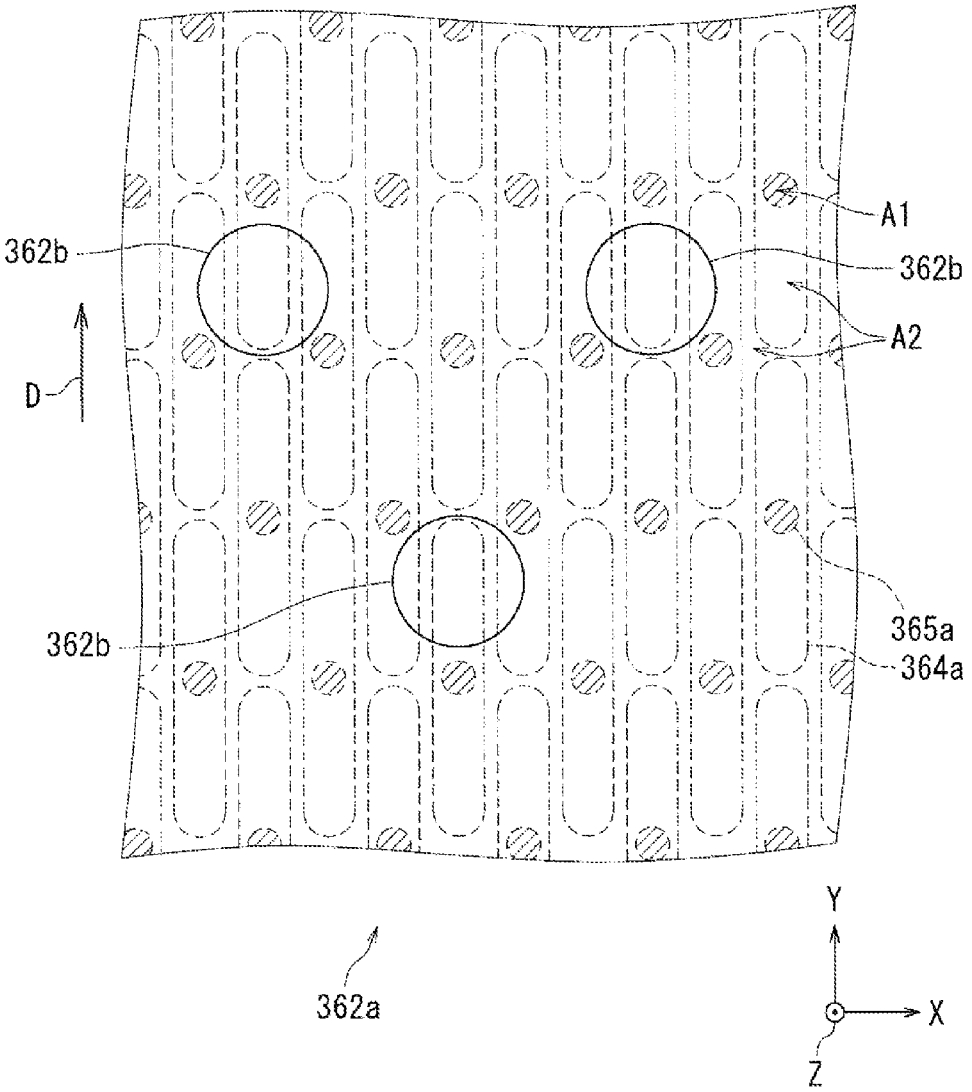
FIG. 4 is a plan view showing the positional relationship between through holes and an air outlet in the conveyor device according to the first embodiment of the present disclosure.

A variation of the air outlet 362*b* according to the first embodiment will be described with reference to FIGS. 2 and 4. FIG. 4 is a plan view illustrating the positional relationship between through holes 365*a* and air outlets 362*b*. The fan 363*a* and the fan shaft 363*b* are not shown in FIG. 4 in order to clearly show the positional relationship. The variation is different from the first embodiment in that the air outlets 362*b* of the variation each have a smaller diameter than the air outlet 362*b* shown in FIG. 3.

The fan 363*a* in the variation is smaller-sized. The smaller-sized fan 363*a* allows reduction of the diameter of the air outlets 362*b*. The size of the fan 363*a* is determined according to the distance among the plurality of through holes 365*a*. Accordingly, the through holes 365*a* do not overlap with the air outlets 362*b*. Thus, it is possible to reduce contamination of the fan 363*a* without changing the positions of the through holes 365*a*.

Second Embodiment

Basic Configuration

Figure 5:
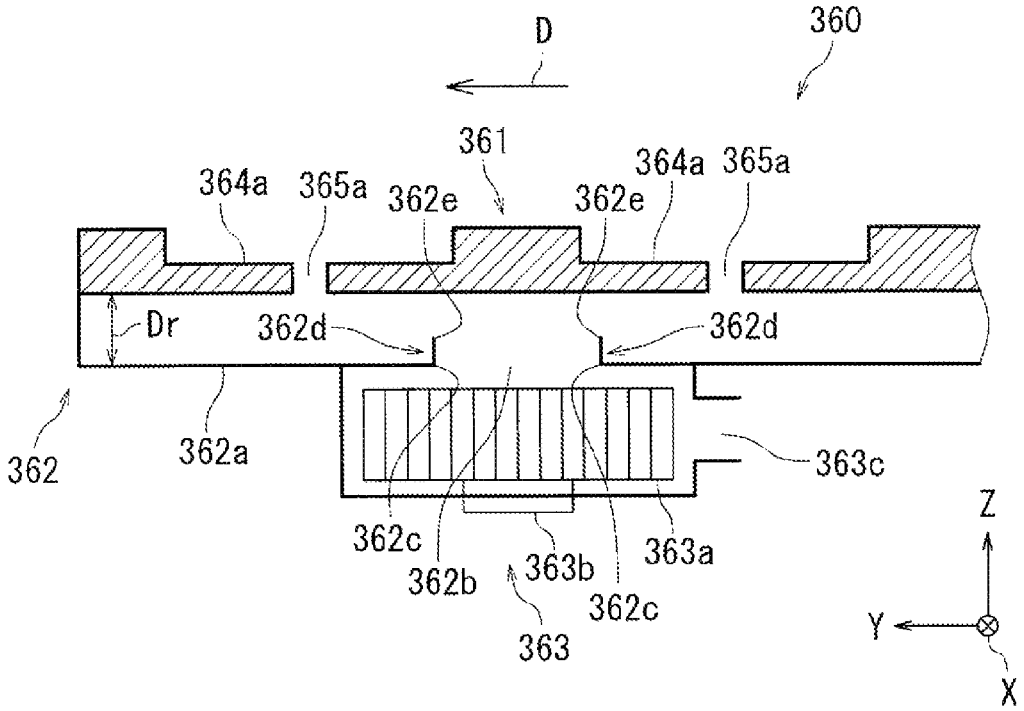
FIG. 5 is a side view illustrating a suction section of a conveyor device according to a second embodiment of the present disclosure.

The basic configuration of the conveyor device 300 according to a second embodiment of the present disclosure will be described with reference to FIG. 5. FIG. 5 is a side view illustrating the suction section 360. The second embodiment is different from the first embodiment in that the air flow chamber 362 of the second embodiment has a projection 362*d*.

The air flow chamber 362 in the conveyor device 300 according to the second embodiment has the projection 362*d* in the second region A2. The projection 362*d* is formed along the peripheral edge 362*c* of the air outlet 362*b*. Specifically, the projection 362*b* is a rib or a bank, for example. The height of the projection 362*d* based on the horizontal level of the bottom 362*a* is 1 to 2 mm. However, the height of the projection 362*d* may be increased or decreased according to a depth Dr of the air flow chamber 362. A top edge 362*e* of the projection 362*d* is at a higher level than the horizontal level of the second region A2 in the bottom 362*a*. Thus, the projection 362*d* can hold back ink that has been abnormally ejected and that has flowed into the air flow chamber 362.

[Variation of Projection 362*d*]

Figure 6A:
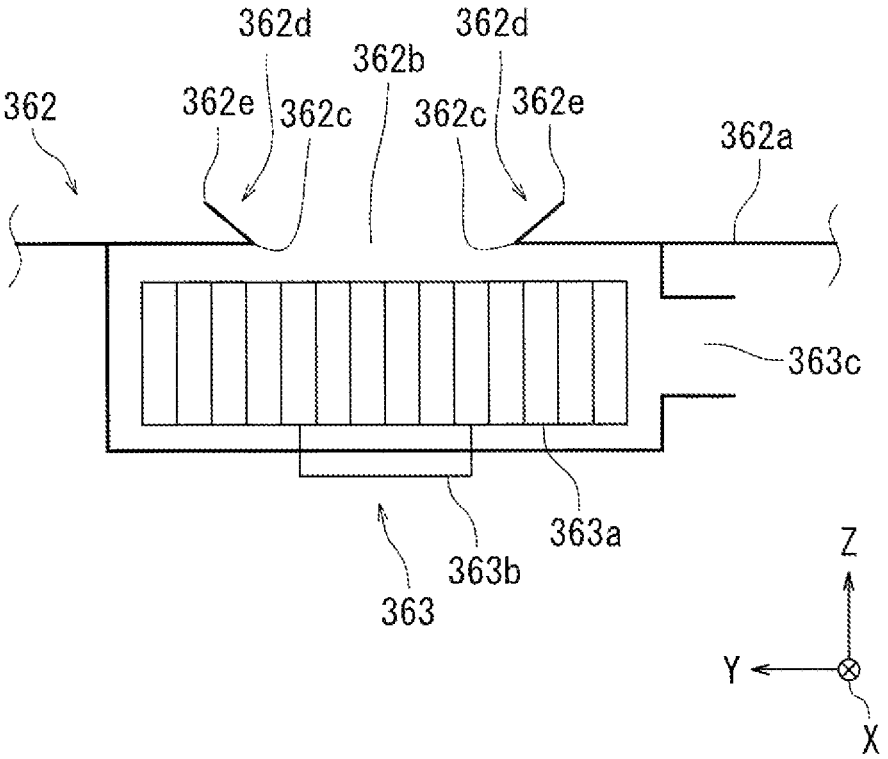
FIG. 6A is a side view illustrating a projection of a conveyor device according to the second embodiment of the present disclosure.
Figure 6B:
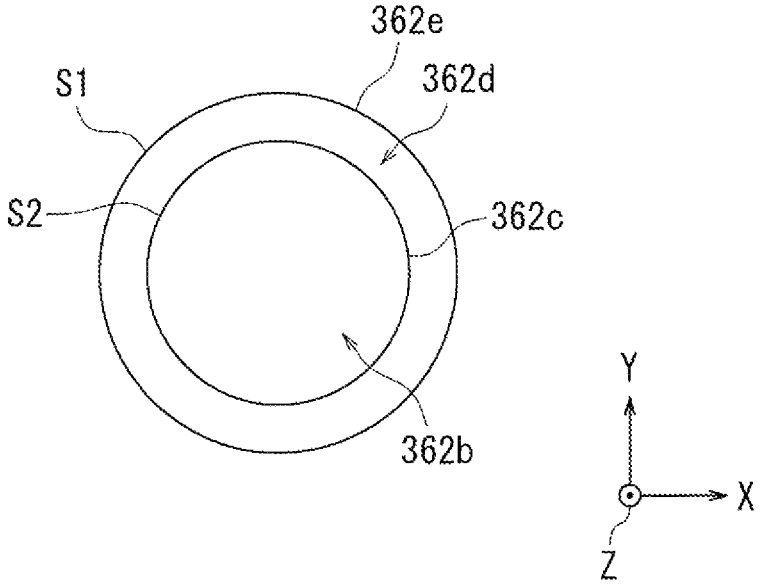
FIG. 6B is a plan view illustrating the projection of the conveyor device according to the second embodiment of the present disclosure.
Figure 7A:
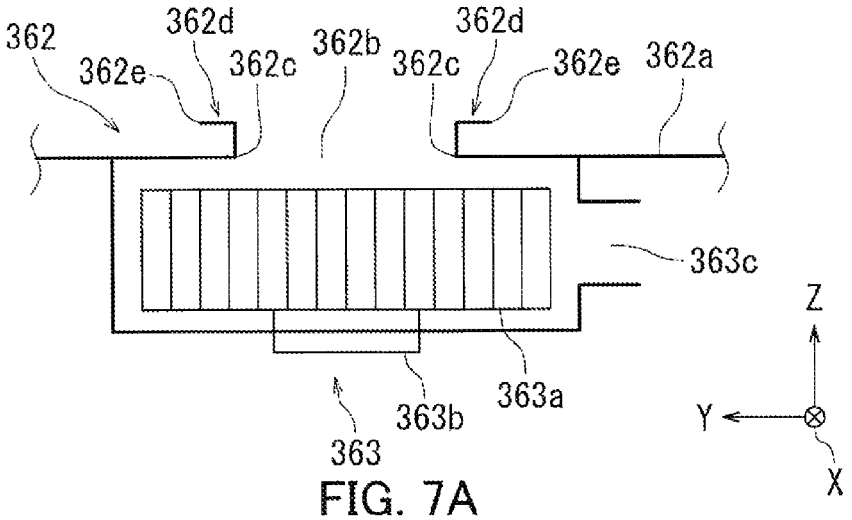
FIGS. 7A-7C are side views each illustrating the projection of the conveyor device according to the second embodiment of the present disclosure.
Figure 7B:
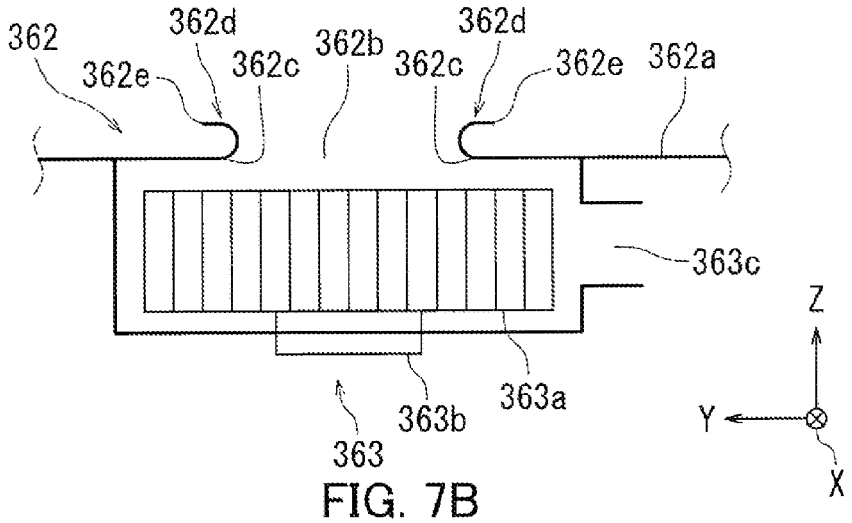
Figure 7C:
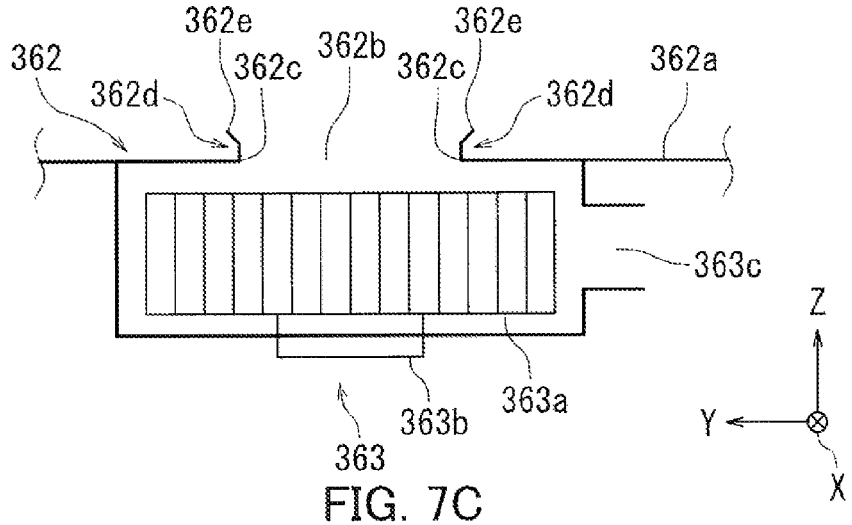

A variation of the projection 362*d* according to the second embodiment will be described with reference to FIGS. 6A-7C. FIG. 6A is a side view illustrating the projection 362*d*. FIG. 6B is a plan view illustrating the projection 362*d*. The fan 363*a* and the fan shaft 363*b* are not shown in FIG. 6B in order to clearly show the positional relationship between the top edge 362*e* of the projection 362*d* and the air outlet 362*b* in a plan view. FIGS. 7A-7C are side views illustrating the projection 362*d*. The projection 362*d* according to the variation is different from the projection 362*d* illustrated in FIG. 5 in that the projection 362*d* according to the variation does not stand upright.

As illustrated in FIGS. 6A and 6B, an area 51 of a region defined by the top edge 362*e* of the projection 362*d* is greater than an area S2 of a region defined by the peripheral edge 362*c* of the air outlet 362*b*. The projection 362*d* is projected in an oblique manner in a cross-section along the Z axis. The top edge 362*e* of the projection 362*d* is located outside of the air outlet 362*b* in a plan view from the direction of the Z axis.

The projection 362*d* illustrated in FIGS. 6A and 6B leads ink that has been abnormally ejected and that has arrived at the projection 362*d* away from the air outlet 362*b* in a way according to the shape of the projection 362*d*. It is therefore possible to prevent the ink from flowing into the air outlet 362*b* more effectively.

In a configuration in which the projection 362*d* is projected in an oblique manner, it is preferable that the region defined by the top edge 362*e* of the projection 362*d* does not overlap with the first regions A1 in a plan view from the direction of the Z axis. Thus, ink flowing through the through holes 365*a* is prevented from falling directly on the projection 362*d* in the case of abnormal ink ejection.

The projection 362*d* may have an inverted L shape in a cross-section along the Z axis as illustrated in FIG. 7A. Such a shape of the projection 362*d* provides the projection 362*d* with a horizontal level. Accordingly, a section of the shape of the projection 362*d* that is angled toward the air outlet 362*b* can be smaller. Such a shape allows reduction of the amount of ink that flows into the air outlet 362*b* after having landed on the projection 362*d* even when the top edge 362*e* of the projection 362*d* overlaps with any of the first regions A1 in a plan view from the direction of the Z axis.

Alternatively, the projection 362*d* may include a section having a curved shape as illustrated in FIG. 7B. Ink that has flowed into the air flow chamber 362 and hit the projection 362*d* is led away from the air outlet 362*b* along the curved shape. Thus, the shock upon impact of ink on the projection 362*d* can be reduced. Accordingly, the projection 362*d* can hold back the ink while preventing ink spattering.

Alternatively, the projection 362*d* may have a shape including a section standing upright and a section projected in an oblique manner in a cross-section along the Z axis as illustrated in FIG. 7C. The length of the section projected in an oblique manner may be shorter than the length of the projection 362*d* illustrated in FIG. 6A in a cross-section along the Z axis. Thus, the area of the region defined by the top edge 362*e* of the projection 362*d* can be reduced in a plan view from the direction of the Z axis. As a result, ink flowing downward through the through holes 365*a* can be prevented from falling directly on the projection 362*d* in the case of abnormal ink ejection.

Third Embodiment

Basic Configuration

Figure 8:
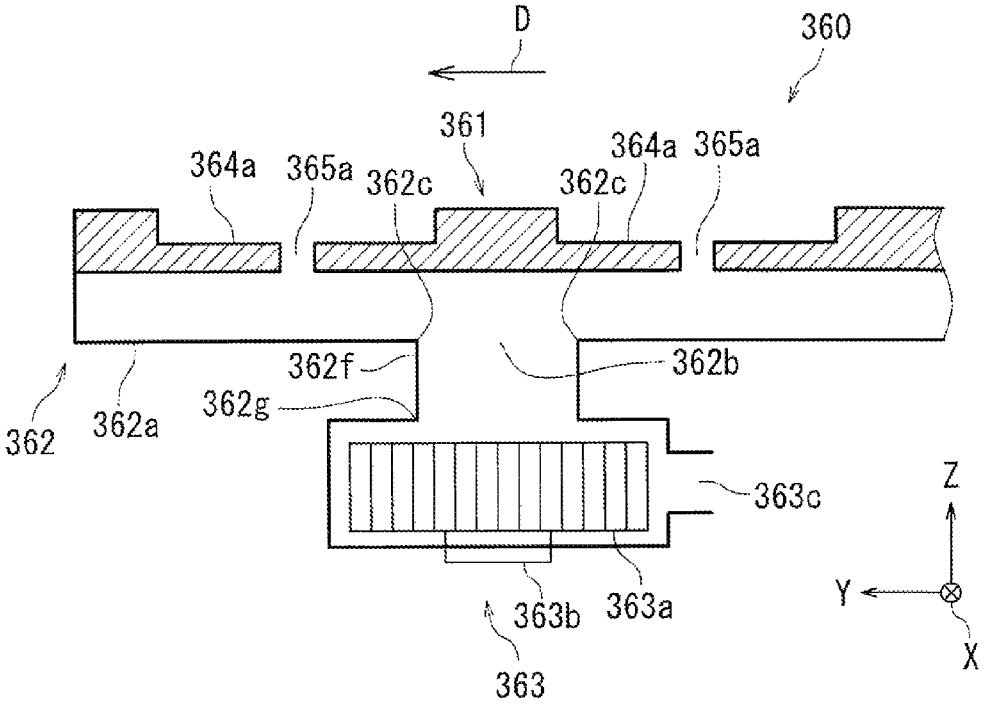
FIG. 8 is a side view illustrating a suction section of a conveyor device according to a third embodiment of the present disclosure.

The basic configuration of the conveyor device 300 according to a third embodiment of the present disclosure will be described with reference to FIG. 8. FIG. 8 is a side view illustrating the suction section 360. The third embodiment is different from the first and second embodiments in that the air flow chamber 362 of the third embodiment has a connection section 362*f*.

In the third embodiment, the air flow chamber 362 has the connection section 362*f*. The connection section 362*f* is connected with the bottom 362*a* at the air outlet 362*b*. A lower end of the connection section 362*f* is connected with the sucking device 363. Specifically, the connection section 362*f* is a duct, for example. The connection section 362*f* has a straight cylindrical shape in parallel to the Z axis. The cross-section of the connection section 362*f* along the Y axis has a circular, oval, rectangular, or polygonal shape, for example. The connection section 362*f* includes an opening end facing the air flow chamber 362 and an opening end 362*g* facing the sucking device 363. The opening end of the connection section 362*f* that faces the air flow chamber 362 is connected with the peripheral edge 362*c* of the air outlet 362*b*. The opening end 362*g* facing the sucking device 363 is connected with the sucking device 363.

Negative pressure acts on the recording medium P through the opening end 362*g* of the connection section 362*f*, the air outlet 362*b*, the through holes 365*a*, the grooves 364*a*, and the suction holes of the conveyor belt 355. The sucking device 363 is disposed inside of the second paper conveyance section 350 as illustrated in FIG. 1. Alternatively, the sucking device 363 may be disposed outside of the second paper conveyance section 350 according to the design.

The air flow chamber 362 has the connection section 362*f* as described with reference to FIG. 8. The connection section 362*f* provides a distance between the air outlet 362*b* and the fan 363*a* corresponding to the length of the connection section 362*f* along the Z axis. Accordingly, ink that has been abnormally ejected and that has flowed into the air flow chamber 362 does not reach the fan 363*a* easily.

The connection section 362*f* illustrated in FIG. 8 is connected with the bottom 362*a* along the vertical direction. Alternatively, the connection section 362*f* may be disposed obliquely to the vertical direction. Preferably, a region defined by the opening end of the connection section 362*f* that faces the air flow chamber 362 (the peripheral edge 362*c* of the air outlet 362*b*) does not overlap with a region defined by the opening end 362*g* of the connection section 362*f* that faces the sucking device 363. Such a configuration encourages ink to attach to an inner wall of the obliquely disposed connection section 362*f* in the case of abnormal ink ejection. Accordingly, the ink does not reach the fan 363*a* easily.

A flow channel in the connection section 362*f* illustrated in FIG. 8 is straight but may be stepped. The stepped flow channel encourages ink to attach to the inner wall of the connection section 362*f* in the case of abnormal ink ejection. Accordingly, the ink does not reach the fan 363*a* easily.

So far, the embodiments of the present disclosure have been described with reference to the drawings (FIGS. 1-8). However, the present disclosure is not limited to the above-described embodiments and can be practiced in various ways within the scope not departing from the gist of the present disclosure (e.g., the following (1)-(4)). The drawings are intended to illustrate mainly the components in a schematic manner to assist with understanding. The thickness, the length, the number, and so on of each component illustrated or the space between components are not true to scale for diagrammatic purposes. The shape, the dimension, and so on of each component shown in the above-described embodiments are exemplary only and not particularly limited. Various alternations can be made thereto within the scope not substantially departing from the effect of the present disclosure.

(1) The sucking device 363 is a fan according to the description made with reference to FIGS. 1, 2, and 5-8. Alternatively, the sucking device 363 may be a vacuum pump.

(2) The guide member 361 has the through holes 365*a* in communication with the grooves 364*a* according to the description made with reference to FIGS. 2 and 3. Alternatively, the guide member 361 may have the through holes 365*a* without having the grooves 364*a*.

(3) The peripheral edge 362*c* of the air outlet 362*b* has a circular shape according to the description made with reference to FIGS. 2-8. Alternatively, the peripheral edge 362*c* may have another shape (e.g., an oval, rectangular, or polygonal shape). The shape of the peripheral edge 362*c* of the air outlet 362*b* may be changed according to the position and the shape of the second region A2. Thus, it is possible to easily reduce contamination of the fan 363*a* by ink without changing the positions of the sucking device 363 and the through holes 365*a*.

(4) One groove 364*a* has one through hole 365*a* according to the description made with reference to FIGS. 3 and 4. Alternatively, one groove 364*a* may have a plurality of through holes 365*a*.

What is claimed is:

1. A conveyor device comprising:

a conveyor belt configured to convey a recording medium; and a suction section configured to suck on the recording medium through the conveyor belt, the suction section including:

a guide member configured to support the recording medium via the conveyor belt; and an air flow chamber disposed under the guide member and having a box-like shape with a top opening, wherein the guide member covers the top opening of the air flow chamber, the guide member is provided with a plurality of through holes penetrating the guide member in a thickness direction, the air flow chamber has a bottom, the bottom has an air outlet, and the air outlet is located so as to avoid being right under any of the through holes.

2. The conveyor device according to claim 1, wherein the suction section further includes a sucking device that is in communication with the air flow chamber via the air outlet, the air flow chamber has a connection section connected with the bottom at the air outlet, and the connection section has a lower end connected with the sucking device.

3. The conveyor device according to claim 1, wherein the air flow chamber has a projection along a peripheral edge of the air outlet, and the projection is located so as to avoid being right under any of the through holes.

4. The conveyor device according to claim 3, wherein a region defined by a top edge of the projection has a larger area than a region defined by the peripheral edge.

5. The conveyor device according to claim 3, wherein the projection has a cross-section in an inverted L shape.

6. The conveyor device according to claim 3, wherein the projection has a cross-section including a curved shape.

7. An inkjet recording apparatus comprising:

the conveyor device according to claim 1; and a recording head disposed opposite to the conveyor device.

* * * * *